US006211614B1

(12) United States Patent
Katayama et al.

(10) Patent No.: US 6,211,614 B1
(45) Date of Patent: Apr. 3, 2001

(54) ELECTRODE STRUCTURE OF AN AC TYPE PLASMA DISPLAY PANEL

(75) Inventors: Takashi Katayama; Hitoshi Hirakawa; Seiki Kurogi; Hiroyuki Nakahara, all of Akashi (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/046,569

(22) Filed: Mar. 24, 1998

(30) Foreign Application Priority Data

Aug. 13, 1997 (JP) ..... 9-218436

(51) Int. Cl.[7] ..... H01J 11/00; H01J 17/49
(52) U.S. Cl. ..... 313/582; 313/587
(58) Field of Search ..... 313/581, 582, 313/584, 585, 586, 587

(56) References Cited

U.S. PATENT DOCUMENTS 5,909,083 * 6/1999 Asano et al. ..... 31/584
5,939,828 * 8/1999 Matsuzaki et al. ..... 313/584
5,952,782 * 9/1999 Nanto et al. ..... 313/584
5,952,783 * 9/1999 Kuroki et al. ..... 313/590
5,977,708 * 11/1999 Amatsu et al. ..... 313/586
5,990,617 * 11/1999 Kanae et al. ..... 31/582

OTHER PUBLICATIONS

U.S. Ser. No. 08/733,008, Thanh et al., filed Oct. 16, 1996.

* cited by examiner

*Primary Examiner*—Nimeshkumar D. Patel
*Assistant Examiner*—Matthew John Gerike
(74) *Attorney, Agent, or Firm*—Staas & Halsey LLP

(57) ABSTRACT

An AC type plasma display panel having a first and a second electrode, each extending along a line direction and aligning along a row direction across a discharge gap therebetween, where is formed a display discharge cell. A third electrode extends along the row direction and intersects the first and second electrodes. Thus a display matrix is formed with the lines and the rows, and an address discharge cell is formed with the second electrode and the third electrode. Each of the first and second electrodes comprises a laminate of an electrically conductive transparent film stripe having a first side distant from the discharge gap and a second side near to the discharge gap with a metal film stripe thereon. A width of the metal film stripe is narrower than a width of the transparent film stripe. The metal film stripe has a third side distant from the discharge gap, and a fourth side near to the discharge gap. The metal film stripe of at least the first electrode is located such that a first distance between the second side and fourth side is smaller than a second distance between the first side and third second side, whereby a reliable long term operation can be accomplished while reducing the load of the driving circuit without decreasing the luminous efficiency.

8 Claims, 8 Drawing Sheets

ELECTRODE STRUCTURE OF AN AC TYPE PLASMA DISPLAY PANEL

BACKGROUND OF THE INVENTION

1. Field of the invention

This invention relates to a plasma display panel, referred to hereinafter as a PDP, of a matrix display of an AC driving type, and more particularly, relates to a surface discharge form, in which the discharge is generated along the display surface.

2. Description of the Related Arts

PDP is a thin matrix display panel of self-luminous type of a display, and has been widely employed in the application to television pictures and computer monitors upon the achievement of the color display. PDPs have also been remarkable for the large size flat display device, such as for the use in the HDTV, High Definition Television.

A memory effect is utilized in sustaining the lighting state of the cells of the display elements in the PDP of the matrix display type. The AC type PDP is constituted such that the structure has a memory function by coating an insulating material upon electrodes. In the display of the AC type PDPs, a line sequential addressing is performed to accumulate wall charges only in the cells to be luminous, i.e. to be lit; next, sustain voltages of alternating polarization are simultaneously applied onto the entire cells. The sustain voltage is of a predetermined voltage lower than the discharge firing voltage. In the cells having the wall charges therein the sustain voltage superposed with the wall voltage makes the effective voltage applied to the cell exceed the firing voltage resulting in generation of the discharge. Shortening of the sustain voltage application interval provides a visually continuous lighting state.

AC type PDPs of surface discharge form have been commercially on market as color display devices. The surface discharge form is such that pairs of sustain electrodes which are arranged in parallel on a single substrate and one of the pair alternately becomes anode and cathode during a sustain period, that is a display period. The surface discharge form PDP allows us to expect a long operating life by arranging fluorescent material layers for color display on an opposing substrate so as to reduce electron bombardment thereon during the discharge.

FIG. 10 schematically illustrates an internal structure of a prior art PDP 90. FIG. 11 schematically illustrates a luminous strength distribution along the aligning direction of the prior art sustain electrodes.

In PDP 90, on an inner surface of a front glass substrate 91 are arranged pairs of sustain electrodes, that are a first and a second electrode 93 & 94 for each single line of the display matrix. These sustain electrodes 93 & 94 are insulated from a discharge space 99 by a dielectric layer 96. Upon a surface of dielectric layer 96 is provided a protection layer 97 formed of a material having a high secondary emission coefficient. Upon an inner surface of a back glass substrate 92 are arranged the third electrodes 95, that are address electrodes, for each row orthogonal to sustain electrodes 93 & 94. There is provided a fluorescent material layer 98 so as to cover the back glass substrate 92 including the upper surface of address electrodes 95. The type of the fluorescent material layer 98 arranged on the back substrate is called a reflection type. The type of the fluorescent material layer 98 is arranged on the front substrate is called a transmission type. The reflection type is more advantageous than the transmission type in the brightness and the view angle characteristics because the lighting surface of the fluorescent material layer 98 can be directly observed.

First sustain electrode 93 is a composite electrode in which an electrically conductive transparent film 931 is stacked with a metal film 932 as a supplemental conductor which is narrower in the width than electrically conductive transparent film 931, and extends along the line direction. Second sustain electrode 94 is also a stack of an electrically conductive transparent film 941 and a metal film 942, similar to sustain electrode 93. Widths of transparent films 931 & 941 are chosen according to the cell size so that an appropriate electrode spacing is secured between the adjacent lines and the surface discharge can extend widely within the cell. Widths of metal films 932 & 942 are chosen depending on the length so as to secure the electrical conductivity more than the allowable lowest limit. Electrode spacing S2 between the adjacent lines is called an inverse slit.

In the display using PDP 90 a line-sequential addressing is performed. In lighting a cell, address electrode 95 and second electrode 94 are respectively biased appropriately so as to cause an opposing discharge therebetween along the substrate thickness direction so that the surface of the dielectric layer 96, where protection layer 97 is included therein, is appropriately electrically charged, which is called a wall charge. After the addressing operation to determine the lighting/non-lighting of each cell by thus generated wall charge, sustain voltages are applied to first and second sustain electrodes 93 & 94 where the polarity of the applied potential difference is alternately changed, whereby the surface discharges are cyclically generated in the display cells in which the wall charges have been formed. Fluorescent material layer 98 emits a predetermined visible light by being locally excited by an ultraviolet light generated in the surface discharge. The light transmitted through the glass substrate becomes the display light.

As shown in FIG. 11, the luminous strength of the emitted light within each cell becomes maximum at the center of the surface discharge gap S1, which is referred to as a discharge slit, and becomes smaller as leaving along the row direction from the center. In the prior art technique, the metal films 932 & 942 are arranged so as to shift to an extreme end from the surface discharge gap S1, i.e. the side near to the inverse slit S2, of transparent films 931 & 941 in order to minimize the decrease in the luminous strength.

It has been constantly required that the driving voltages of PDPs be lowered from the view points of power consumption, thermal matters and minimization of the driving circuits.

However, on the other hand the display has been required to be finer; accordingly, the cell size must become smaller. In a smaller cell, the discharge firing voltage rises due to the suppression of the movement of the charged particles. This fact is considered that the plasma confined into a small area is likely to cause the reunion to the wall charges, and the amount of the wall charges are so insufficient as to maintain the effective voltage.

In the prior art structure, it has been a problem in that though the shadowing by the metal films 932 & 942 can be kept minimum the luminous efficiency, i.e. brightness/power consumption, is decreased as the cell size is decreased.

SUMMARY OF THE INVENTION

It is a general object of the invention to provide an AC driven matrix type PDP of surface discharge type.

An AC type plasma display panel includes a first and a second electrode, each extending along a line direction and aligning along a row direction across a discharge gap therebetween, where is formed a display discharge cell; a third electrode extending along the row direction and intersecting the first and second electrodes, thus a display matrix is formed with the lines and the rows, an address discharge cell is formed with the second electrode and the third electrode. Each of the first and second electrodes comprises a laminate of an electrically conductive transparent film stripe having a first side distant from the discharge gap and a second side near to the discharge gap; and a metal film stripe thereon, a width of the metal film stripe is narrower than a width of the transparent film stripe, the metal film stripe having a third side distant from the discharge gap, and a fourth side near to the discharge gap; wherein the metal film stripe of at least the first electrode is located such that a first distance between the second and fourth sides is smaller than a second distance between the first and third sides.

The above-mentioned features and advantages of the present invention, together with other objects and advantages, which will become apparent, will be more fully described hereinafter, with references being made to the accompanying drawings which form a part hereof, wherein like numerals refer to like parts throughout.

A BRIEF DESCRIPTION OF THE DRAWINGS

FIG. 1 schematically illustrates a perspective view of an inner structure of PDP 1 of the present invention;

FIG. 2 illustrates the electrode matrix of the PDPs;

FIG. 3 schematically illustrates a cross-sectional cut view of the main part of the PDP;

FIG. 4 schematically illustrates the structure of a sustain electrode pair;

Figure 7:
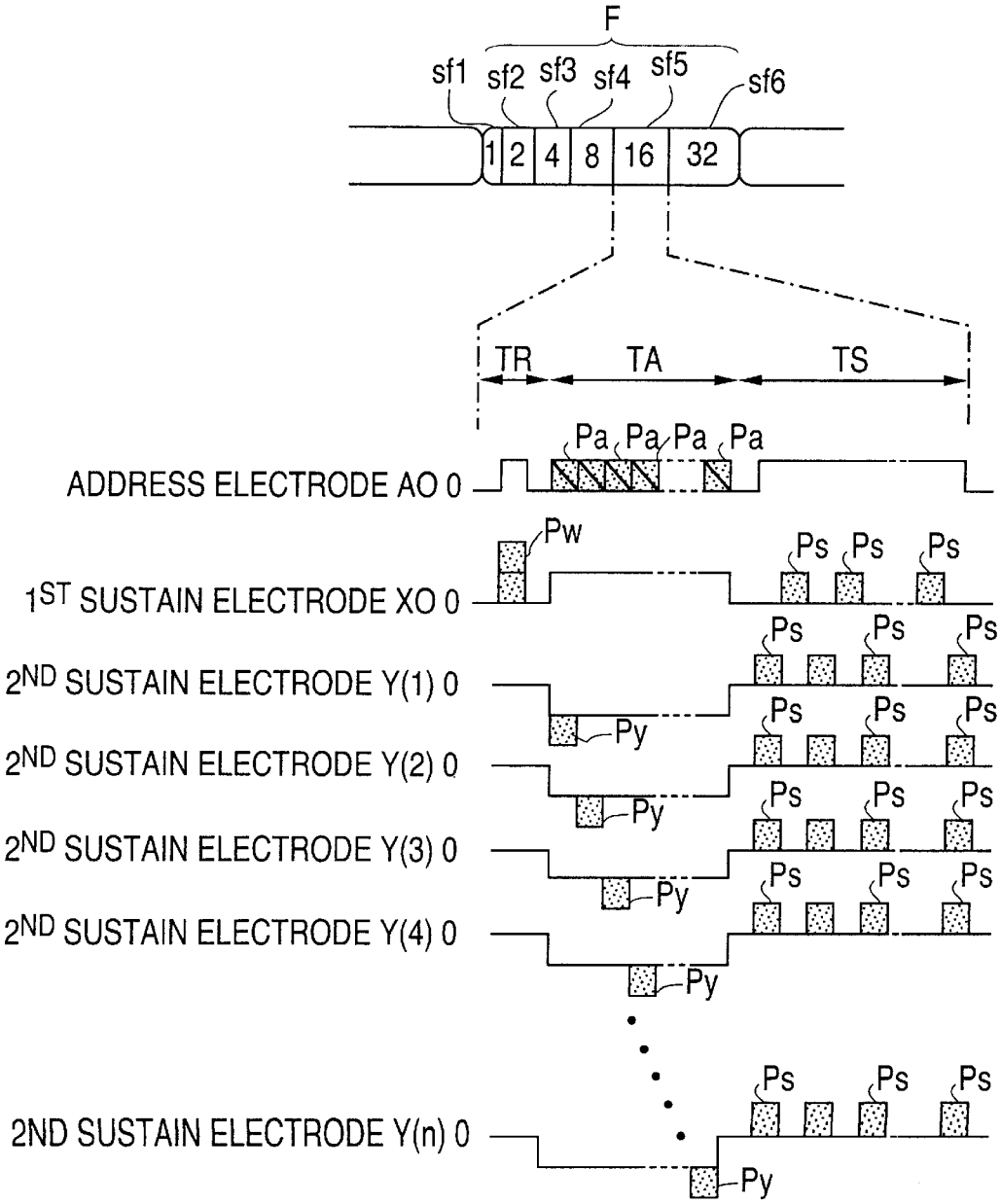
Figure 8:
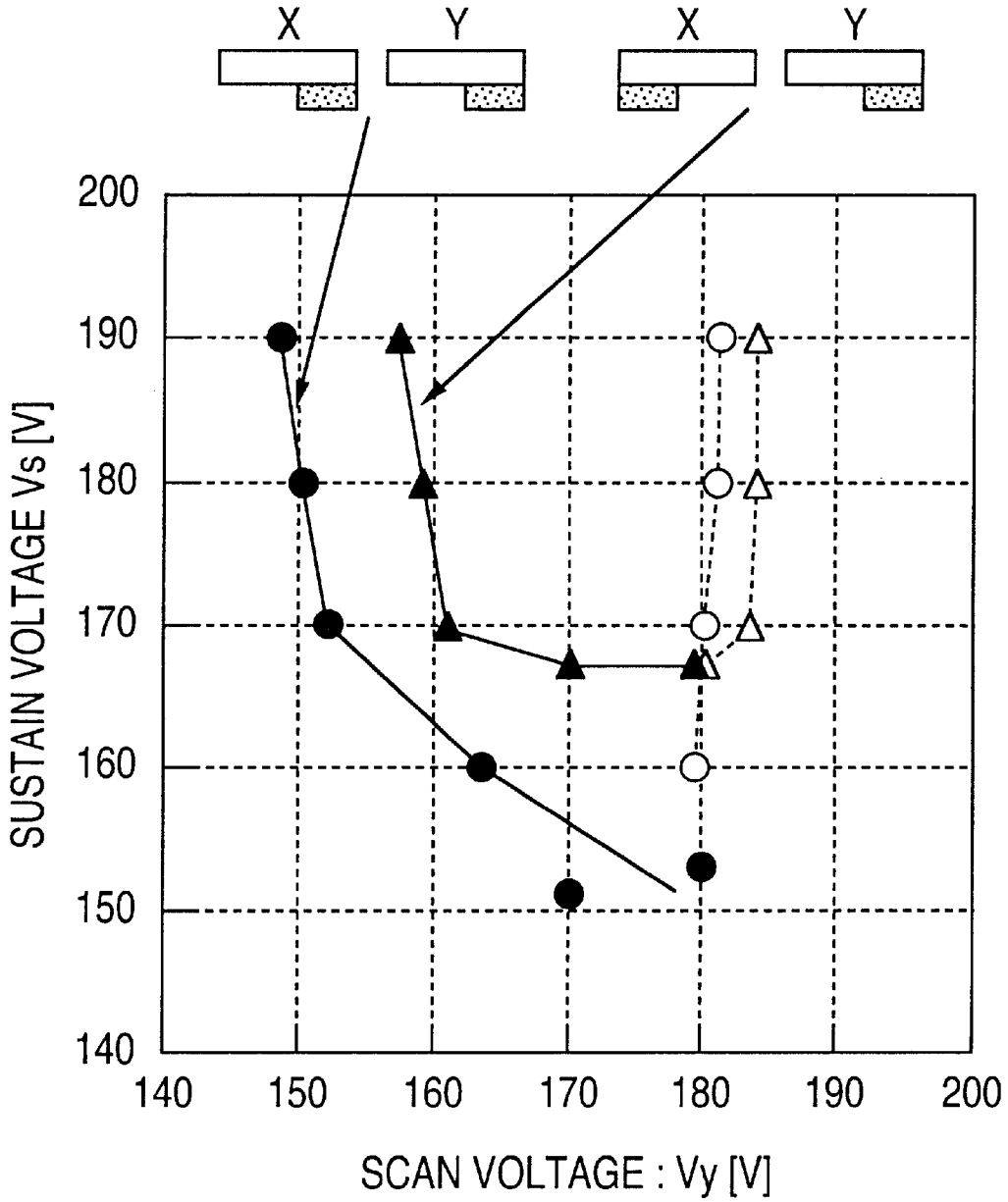
Figure 9:
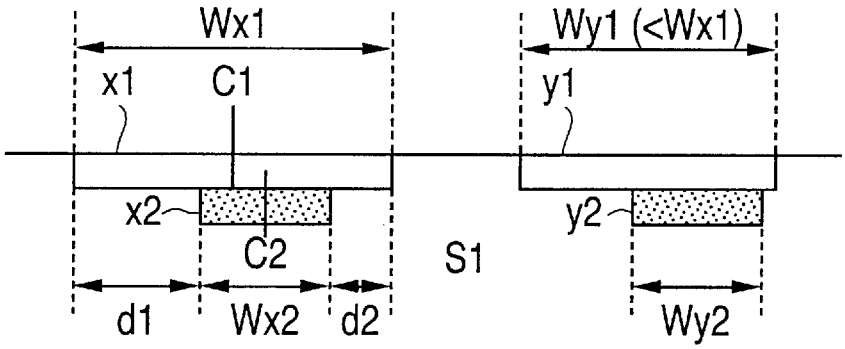
Figure 10:
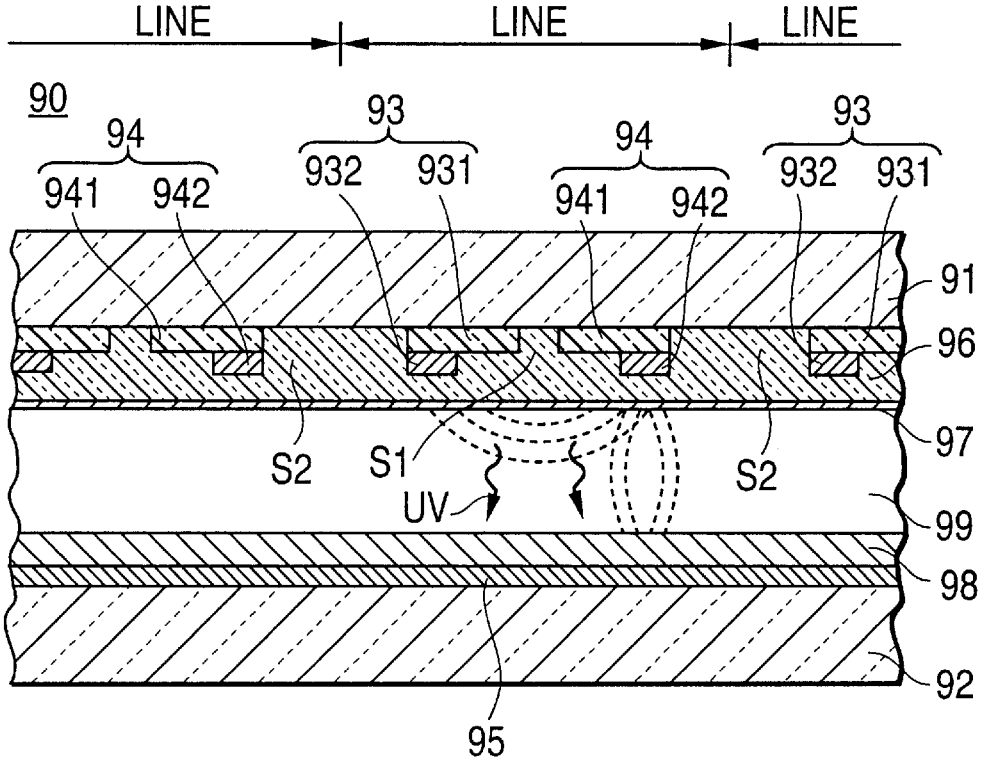
FIG. 10 (PRIOR ART)
Figure 11:
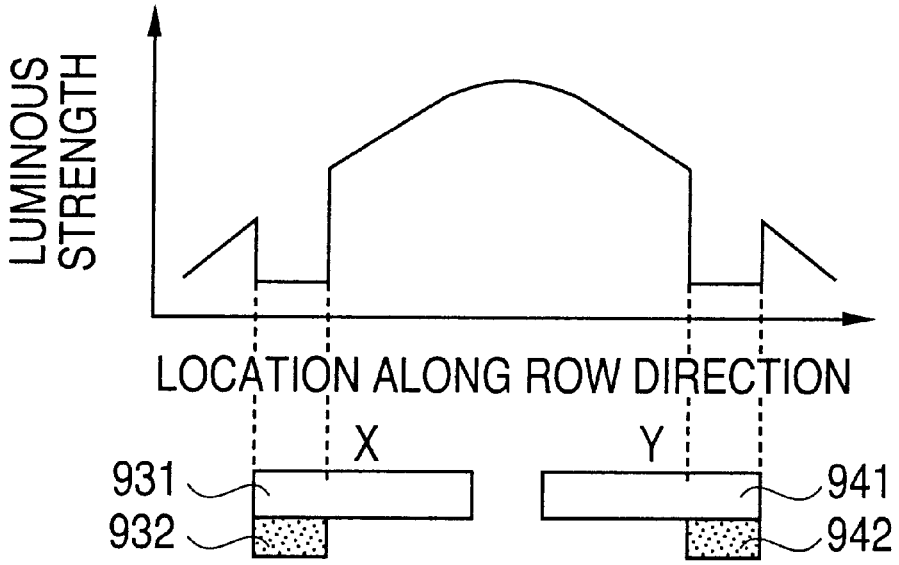
FIG. 11 (PRIOR ART)

FIG. 7 showns voltage waveforms illustrating the driving sequence;

FIG. 8 schematically illustrates the operational margin of the dynamic drive;

FIG. 9 schematically illustrates a second preferred embodiment of the present invention showing the sustain electrode structure;

FIG. 10 schematically illustrates an inner structure of a prior art PDP; and FIG. 11 schematically illustrates the prior art luminous strength distribution measured along the direction of the sustain electrode arrangement.

DETAILED DESCRIPTION OF THE PREFERRED EMBODIMENT

Figure 1:
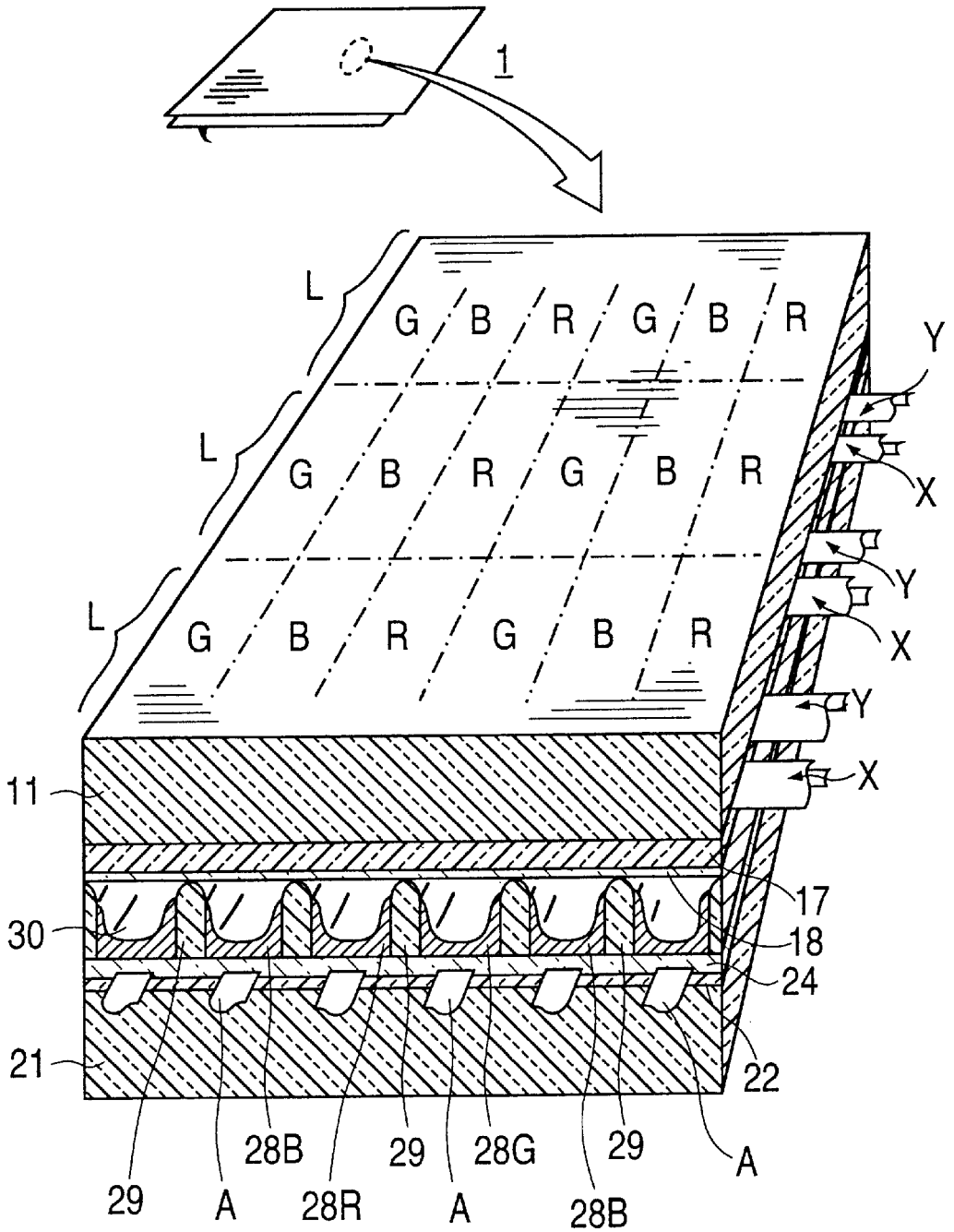
Figure 2:
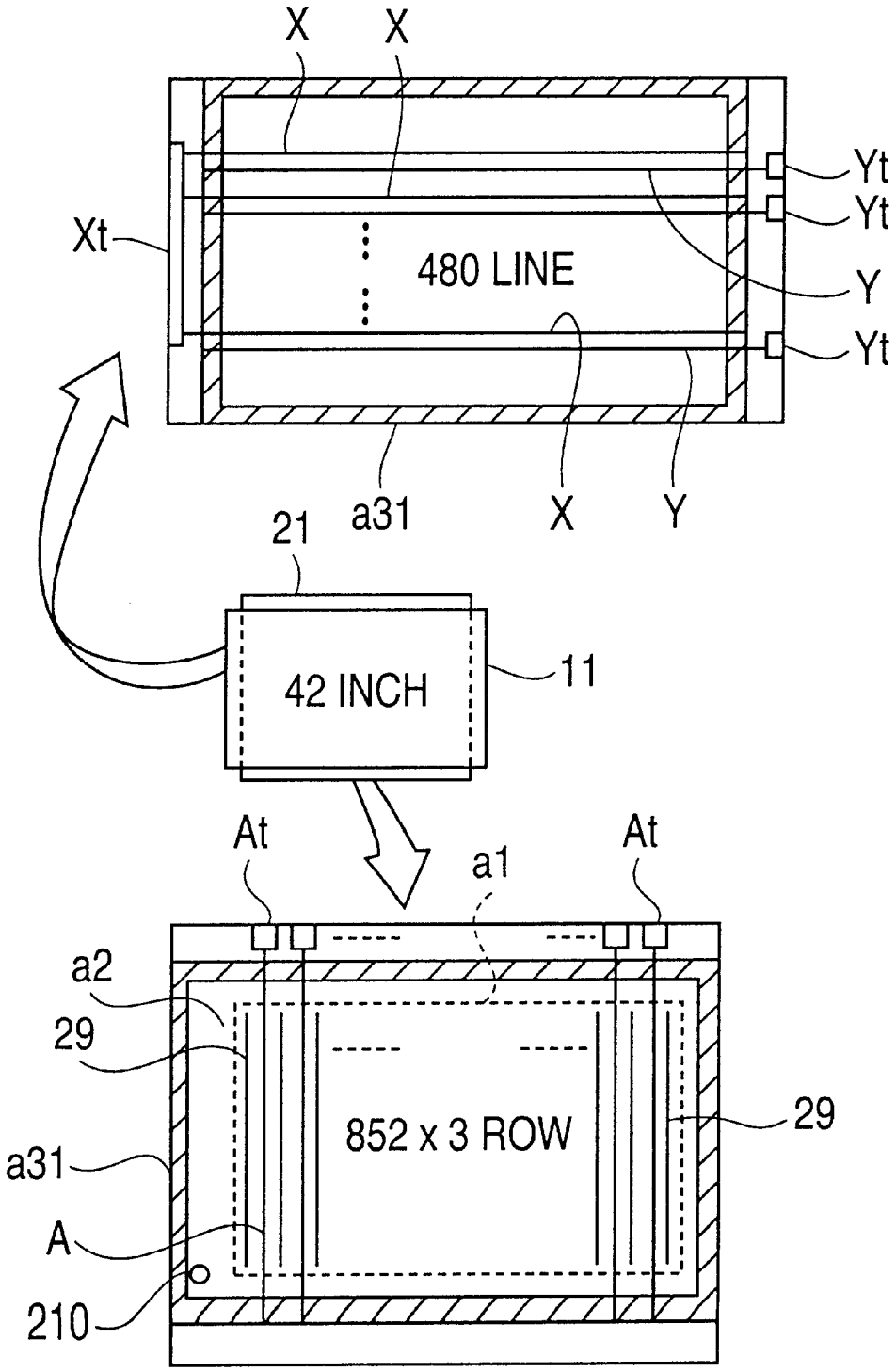

FIG. 1 schematically illustrates a perspective view of an inner structure of PDP 1 of the present invention. FIG. 2 schematically illustrates the electrode matrix of PDP 1, where the electrode arrangement is schematically illustrated viewed from discharge space 30.

PDP 1 of FIG. 1 is an AC type PDP of surface discharge form which is capable of displaying full colors, and is called a reflection type in the classification of the arrangement types of the fluorescent materials.

In PDP 1, first and second sustain electrodes X & Y are arranged on an inner surface of front glass substrate 11. A dielectric layer 17 as thick as about 30 $\mu$g m of a low melting temperature glass is provided upon an entire display area so as to cover the first and second sustain electrodes X & Y from discharge space 30. Upon dielectric layer 17 is formed a several angstrom thick magnesium oxide film as a protection film 18. Dielectric layer 17 and protection film 18 are both transparent. Upon the inner surface of back glass substrate 21 are arranged address electrodes A, i.e. the third electrodes, orthogonal to the sustain electrodes. Address electrodes A are arranged on an undercoat layer 22, and are coated with about a 10 $\mu$m thick dielectric layer 24. Upon dielectric layer 24 is provided between two address electrodes a 150 $\mu$m high separator wall 29, which looks like a stripe when viewed down vertically. Discharge space 30 is divided by separator walls into subpixels, i.e. unit luminous areas, along the line direction; as well as the height of the discharge space is determined with the separator walls. It is preferable for the separator walls to be formed with white glass mixed with white pigment in order to enhance the reflection of the emitted lights. It is also preferable for the tops of the separator walls to be coated with black glass thereon in order to enhance the display contrast. There are provided three color fluorescent material layers 28R, 28G & 28B, denoted hereinafter as simply 28 when the color is not required to be specifically indicated, for the color display so as to cover the surfaces of dielectric layer including the address electrodes and sides of the separator walls. In discharge space 30 is enclosed a discharge gas which is a mixture of neon gas as the majority and xenon gas. The enclosed gas pressure is approximately 500 Torr.

In PDP 1, a single pixel, which is a single picture element of the display, is formed of three subpixels, each of which is a unit luminous area, adjacent along the line direction. The lighting color of the lines in each row is identical. In PDP 1, along the row direction of the display matrix is provided no separator wall for separating discharge space 30, i.e. along the arrangement direction of sustain electrodes X & Y. Accordingly, electrode spacing, i.e. the inverse slit S2, between adjacent lines L is selected, for example, 400 to 500 $\mu$m, which is larger than the surface discharge gap, for example 80 to 140 $\mu$m. A film of dark color is preferably disposed on the inverse slit so that the white color of the fluorescent material cannot be seen during a non-lit state.

A pair of first and second sustain electrodes X & Y corresponds to each line of the display matrix; while a single address electrode A corresponds to a single row. In FIG. 2, a framed area a31 indicated with slanted lines is the area where the front and back glass substrates 11 & 21 are sealed together. All the first sustain electrodes X are led out to a horizontal edge of front glass substrate 11; and all the second sustain electrodes Y are led out to another horizontal edge. First sustain electrodes are electrically connected all together to a common terminal Xt in order to simplify the driving circuit. Each second sustain electrode Y is individually an independent electrode so as to allow the line sequential addressing, and is unified with a respective discrete terminal Yt. Each address electrode A is unified with a respective discrete terminal Yt at a vertical edge of back glass substrate 21. The area where a sustain electrode group and an address electrode group intersect inside the seal area a31 is a picture area a1, that is the screen. At a non-display area a2 between picture area a1 and seal area a31 is provided a through hole 210 for enclosing the discharge gas.

Figure 3:
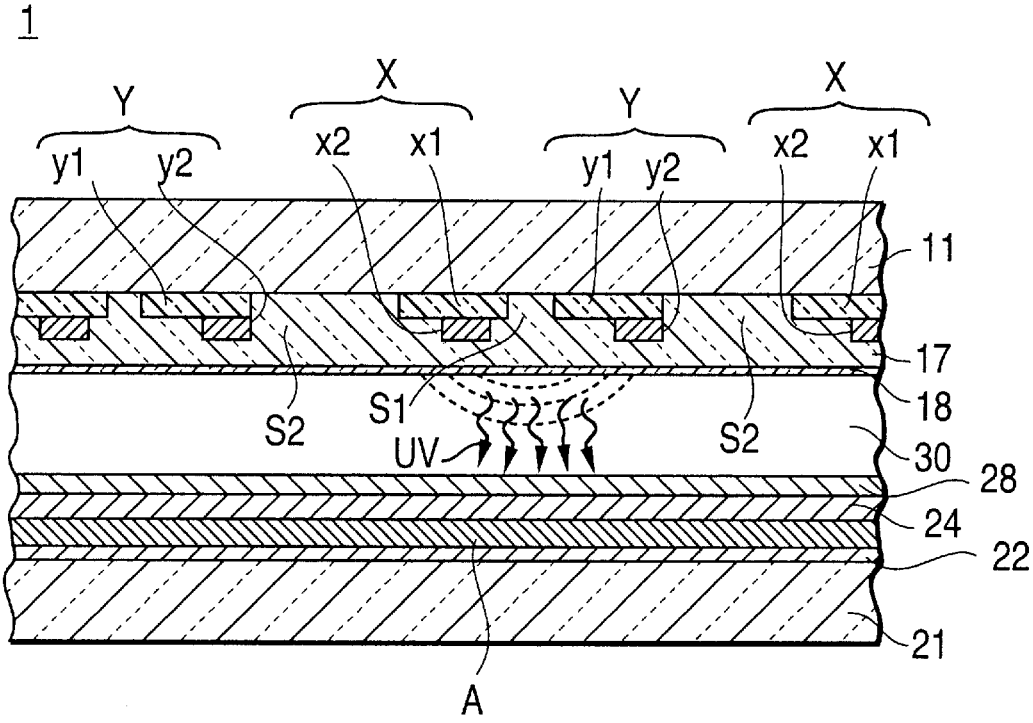
Figure 4:
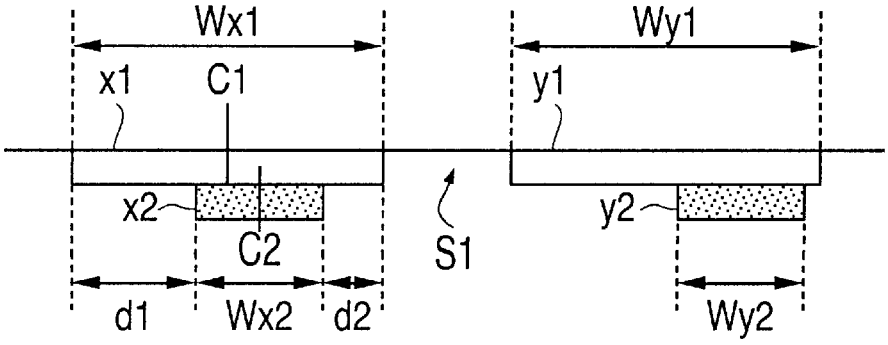
Figure 5:
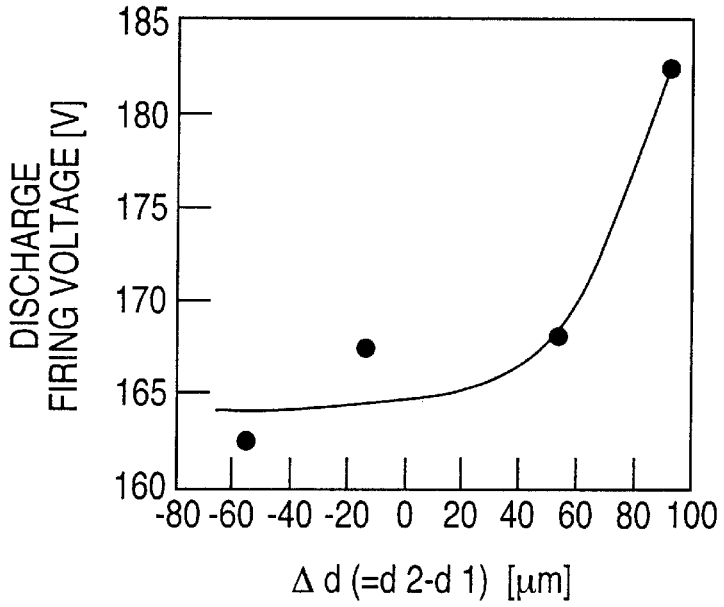
FIG. 5 is a graph illustrating a relation between the location of the metal films and the discharge firing voltage.
Figure 6:
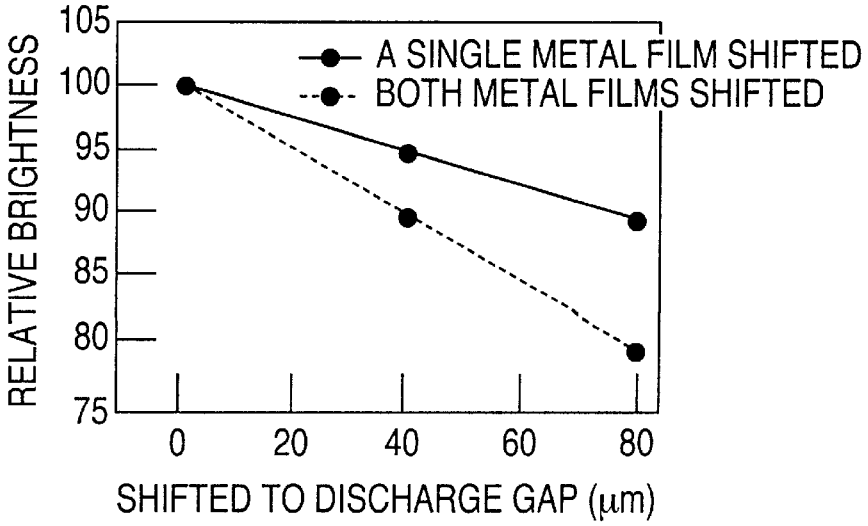
FIG. 6 is a graph illustrating a relation between the location of the metal film x2 and the brightness.

FIG. 3 schematically illustrates a cross-sectional cut view of the main portion of PDP 1. FIG. 4 schematically illustrates a constitution of the sustain electrode pair. FIG. 5 is a graph illustrating a relation of the location of the metal film x2 vs. the discharge firing voltage. FIG. 6 is a graph illustrating a relation of the location of the metal film x2 vs. the brightness.

First sustain electrode X is a composite electrode of a laminate of a first transparent, stripe-like patterned, electrically conductive film x1, referred to hereinafter as a first transparent film, and a first stripe-like patterned metal film x2, i.e. a bus electrode, referred to hereinafter as a first metal film, whose width is narrower than the first transparent film x1. In the similar way, second sustain electrode Y is formed as well of a laminate of a second transparent, stripe-like patterned, electrically conductive film y1, referred to hereinafter as a second transparent film, and a second stripe-like patterned metal film y2, referred to hereinafter as a second metal film, whose width is narrower than the second transparent film y1. The material of the first and second transparent film is an ITO, indium tin oxide. First and second metal films x2 & y2 are nontransparent film typically formed of a three-layer structure of chrome/copper/chrome respectively disposed on first and second transparent films x1 & y1 as the supplemental conductor to reduce the line resistance of first and second sustain electrodes X & Y. In TABLE 1 are shown practical dimensions of sustain electrodes X & Y of a PDP having a 42-inch picture size where the line length is about 960 mm.

TABLE 1

| Structural Elements | Thickness | Width |
|---|---|---|
| Transparent Film | 0.015 to 0.03 μm | 250 to 300 μm |
| Metal Film | 1 to 4 μm | 50 to 200 μm |

The structurally important feature is in that the first metal film x2 of first sustain electrode X in the pair is located such that its center line C2 of the width is nearer to the discharge gap S1 than the center line C1 of the width of first transparent film x1 while the second metal film y2 of second sustain electrode Y, which is engaged in the address discharge with the address electrode, is located distant from the surface discharge gap S1 similarly to the prior art structure. That is, a distance d2 between the first transparent film x1's edge near to the surface discharge gap S1 and the first metal film x2 is smaller than the distance d1 between first transparent film x1's edge distant from the surface discharge gap S1 and the first metal film x2. That is, d2<d1.

The reason why the first metal film x2 is thus arranged is as follows. As shown in FIG. 5, the discharge firing voltage Vf decreases as the difference Δd (=d2−d1) between d2 and d1, both indicating the position of first metal film x2 with respect to first transparent electrode x1, decreases as shown in FIG. 6; however, then the brightness decreases because first metal film x2 is shifted to the luminous center. Accordingly, the location of the first metal film is required to balance the decrease in the brightness and the merit of decreasing the discharge firing voltage. The luminous efficiency can be increased only with the electrode structure where the above conditions are satisfied.

Moreover, by not placing second metal film y2 of second transparent electrode near to the discharge gap S1, the decrease in the thickness of the protection layer 18 as a result of a long secular change does not greatly affect the addressing operation; accordingly, a stable operation can be achieved for a long operation period. That is, the status of the protection film 18's part which covers the second metal film y2 determines the success or failure of the discharge because the opposing discharge during the addressing operation is generated between second metal film y2 protruding towards the opposing substrate and the address electrode A. If second metal film y2 is placed near to the surface discharge gap S1, a discharge error in the addressing operation is likely to take place as the operation hours are accumulated long. The surface discharge is not likely to be affected by the local deterioration of protection film 18 because the surface discharge spreads relatively wide.

In the first preferred embodiment, width Wx1 of first transparent electrode x1 and width Wy1 of second transparent electrode y1 are chosen equal so that the center in the row direction of each cell can be the luminous center whereby the lines can align at the regular intervals. Widths Wx2 of first metal film x2 and width Wy2 of second metal film y2 are also equal, however, can be individually chosen.

PDP 1 of the above-described structure is connected to driving units not shown in the figure so as to be used for a display device such as a wall-hung television receiver, where PDP 1 is electrically connected with the driving units by means of a flexible printed-circuit board.

FIG. 7 schematically illustrates voltage waveforms of the driving sequence. In the display using PDP 1, in order to reproduce the gradation by means of binary control of the lighting of the display cell, each frame F, which is a time-sequence of the externally input picture signal from a signal source, is divided into subframes of, for example six subframes sf1, sf2, sf3, sf4, sf5 and sf6. Numbers of the lightings, i.e. numbers of sustain pulses, which represents the visually relative brightness of the respective subframes sf1–sf6 are set up so as to weight for 1:2:4:8:16:32. Combination of lit or non-lit subframes can provide sixty-four gradations, i.e. 0 to 63 levels, of each color RGB; accordingly, the number of colors capable of being displayed is $64^3$. It is not necessary to allocate the subframes sf1–sf6 in the order of the brightness weights. For example, an optimization can be done by placing subframe sf6 having the maximum weight at the middle of the display period.

A reset period TR, an address period TA and a sustain period TS are allocated in each subframe sf1–sf6. The lengths of the reset period TR and the address period TA are constant regardless to the brightness weight; however, the heavier the brightness weight is, the longer the length of the sustain period TS becomes. Accordingly, the length of the display period of each subframe sf1–sf6 is different from each other.

The reset period TR is a period for erasing, i.e. initializing, the wall charges in the entire screen in order to prevent an influence of the previous lighting state. Onto the first sustain electrodes X of all the lines is applied a reset pulse Pw having positive polarity which exceeds the surface discharge firing voltage while all the second sustain electrodes y2 are kept at a reference level, typically at the ground level; and concurrently onto all the address electrodes A is applied a positive pulse in order to prevent electric charges and ion bombardments on the back substrate. In response to the rise of the reset pulse Pw there are generated strong surface discharges in all the lines resulting in a generation of great amount of wall charges in the cells. The wall charges and the applied voltage are offset so as to lower the effective voltage. Upon the fall of the reset pulse Pw the wall charge itself becomes the effective voltage to cause a self discharge so that most of the wall charges are erased in the entire display discharge cells and in the address cells, whereby the entire screen becomes an uniformly charged state.

The address period TA is a period for addressing, i.e. setting the lighting or non-lighting of, each cell, where first sustain electrodes X are biased to a positive potential with respect to the ground potential while all the second sustain electrodes Y are biased to a negative voltage. At this state, each line is selected sequentially line by line down from the top line, and a scan pulse Py is applied onto the selected one of sustain electrode Y. Concurrent to the line selection an address pulse Pa is applied to an address electrode A which corresponds to a cell to be lit. In the discharge cell applied with the address pulse Pa and on the selected line, there is generated an opposing discharge between second sustain electrode Y and address electrode A. The opposing discharge then forms the wall charge in the nearby display discharge cell, and shifts to the surface discharge in the cell. This sequence of the discharges constitutes the address discharge. No discharge is generated between address electrode A and first sustain electrode X which is biased to a potential of the polarity same as the address pulse Pa, which is accordingly cancelled by this bias.

Sustain period TS is a period for sustaining the lighting state which has been set to provide the brightness according to the gradation level to display. In order to prevent undesirable discharge all the address electrodes A are biased to a positive potential; and at first a sustain pulse Ps of a positive polarity is applied to all the second sustain electrodes Y. Next, the sustain pulses Ps are applied alternately to all first sustain electrodes X and all second sustain electrodes Y. On each application of the sustain pulses Pa the surface discharge takes place in the display discharge cell having the wall charges accumulated therein during the address period. The application cycle of the sustain pulses Ps is generally constant; accordingly, quantity of the sustain pulses in the sustain period is determined according to the brightness weight.

FIG. 8 schematically illustrates the operational margin of the dynamic drive. The solid lines in the figure indicate a characteristic of the electrode structure of the present invention having the first sustain electrode X's metal film shifted to the discharge gap S1. Black circles ● indicate the relation between the lower limit Vymin of scan voltage and sustain voltage Vs; and white circles ○ indicate the relation of the upper limit Vymax vs. scan voltage and sustain voltage Vs. The chain line in the figure indicates a characteristic of the prior art structure where the metal films of first and second sustain electrodes X & Y are shifted distant from the discharge gap S1. In the measurements shown in FIG. 8 there was employed a twenty five inch size PDP of a high resolution display, whose dimensions are shown in TABLE 2.

TABLE 2

| | |
|---|---|
| Width Wx1 of transparent film of 1st electrode X | 95 μm |
| Width Wx2 of metal film of 1st electrode X | 40 μm |
| Dist. d1 between outer edge of electrode X and metal film | 55 μm |
| Width Wy1 of transparent film of 2nd electrode Y | 95 μm |
| Width Wy2 of metal film of 2nd electrode Y | 50 μm |
| Surface discharge gap S1 | 55 μm |

As observed apparently in the figures, the electrode structure of the present invention allows a reliable driving operation while using sustain voltage Vs lower than those for the prior art structure, A second preferred embodiment of the present invention is schematically illustrated in FIG. 9.

In FIG. 9, width Wy1 of second transparent film y1 is chosen narrow, e.g. 80 μm, compared with width Wx1, e.g. 95 μm, of first transparent film x1. Widths of metal films Wx2 & Wy2 respectively of first and second transparent electrodes are identical; however, these widths can be independently chosen. Smaller width Wy1 of the second transparent film y1 makes second metal film y2 be located near to the surface discharge gap S1 so as to allow a wider voltage margin of the addressing operation.

Though the PDPs described in the above preferred embodiments are of the structure where metal film x2 of one of the sustain electrodes is placed nearer to the surface discharge gap S1; however, both of metal films x2 & y2 can be placed nearer to the surface discharge gap S1.

According to the present invention, the load of the driving circuit can be reduced by lowering the discharge firing voltage while avoiding the decrease in the luminous efficiency. Moreover, a highly reliable operation can be accomplished for a long operation term.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications are equivalents may be restored to, falling within the scope of the invention.

What is claimed is:

1. An AC type plasma display panel, comprising:

first and second electrodes, each extending along a line direction and aligning along a row direction across a discharge gap therebetween, a display discharge cell being formed with said first and second electrodes;

a third electrode extending along the row direction and intersecting said first and second electrodes, a display matrix being formed with the lines and the rows, and an address discharge cell being formed with said second electrode and said third electrode; and each of said first and second electrodes comprising a laminate comprising:

an electrically conductive transparent film stripe having a first side distant from the discharge gap and a second side near to the discharge gap, and a metal film stripe thereon, a width of said metal film stripe being narrower than a width of said transparent film stripe, said metal film stripe having a third side distant from the discharge gap, and a fourth side near to the discharge gap, wherein the metal film stripe of at least said first electrode is located such that a first distance between the second side and the fourth side is smaller than a second distance between the first side and the third side.

2. An AC type plasma display panel as recited in claim 1, wherein said metal film stripe of said second electrode is located such that a first distance between the second side and the fourth side is smaller than a second distance between the first side and the second side.

3. An AC type plasma display panel as recited in claim 2, wherein the width of said transparent film stripe of said first electrode is substantially equal to the width of said transparent film stripe of said second electrode.

4. An AC type plasma display panel as recited in claim 2, wherein the width of said transparent film stripe of said second electrode is smaller than the width of said transparent film stripe of said first electrode.

5. An AC type plasma display panel as recited in claim 1, wherein the width of said transparent film stripe of said second electrode is smaller than the width of said transparent film stripe of said first electrode.

6. An AC type plasma display panel as recited in claim 1, wherein said width of the transparent film stripe of said first electrode is substantially equal to the width of said transparent film stripe of said second electrode.

7. An AC type three-electrode plasma display panel including:

a front substrate and a back substrate, for forming a discharge space therebetween;

a plurality of pairs of display electrodes adjacent to each other across a discharge gap upon the front substrate, a display discharge cell being formed with the display electrodes in pair;

a dielectric layer for covering said display electrodes;

a plurality of address electrodes disposed upon the back substrate along a direction intersecting the display electrodes in pair, an address discharge cell being formed at an intersection of a first one of the display electrode pair and the address electrode, wherein the display electrode in pair are both formed with a laminate of an electrically conductive transparent electrode stripe and a metal film having a width which is narrower than a width of the transparent electrode stripe, and wherein one of the display electrodes in pair comprises said metal film stripe such that a center line of the width of said metal film stripe is located closer to the discharge gap than a center line of a width of said transparent electrode stripe.

8. An AC type plasma display panel, comprising:

two electrodes separated by a discharge gap, each of said electrodes comprising:

an electrically conductive transparent film having a first side opposite said discharge gap and a second side nearer said discharge gap;

a metal film formed on each transparent film and having a third side opposite said discharge gap and a fourth side nearer said discharge gap, said metal film being positioned on at least one of the transparent films such that a first distance between the second side and the fourth side is smaller than a second distance between the first side and the third side.

* * * * *